United States Patent [19]

Richmond et al.

[11] 4,013,134

[45] Mar. 22, 1977

[54] PORTABLE EARTH BORING MACHINE WITH STEERING HEAD

[75] Inventors: Albert R. Richmond, West Salem; William S. Appleman, Ashland, both of Ohio

[73] Assignee: The Richmond Manufacturing Company, Ashland, Ohio

[22] Filed: May 20, 1974

[21] Appl. No.: 471,440

[52] U.S. Cl. ..... 175/73; 175/61

[51] Int. Cl.[2] ..... E21B 7/06

[58] Field of Search ..... 175/45, 61, 62, 73, 175/74–76; 403/204, 331, 113, 119

[56] References Cited

UNITED STATES PATENTS

| | | | |
|---|---|---|---|
| 3,141,512 | 7/1964 | Gaskell et al. | 175/61 X |
| 3,190,374 | 6/1965 | Caperan et al. | 175/74 |
| 3,326,008 | 6/1967 | Baran et al. | 175/73 X |
| 3,415,329 | 12/1968 | Mirhord | 175/73 X |
| 3,465,834 | 9/1969 | Southworth | 175/73 X |
| 3,526,285 | 9/1970 | Adkins et al. | 175/73 |
| 3,587,756 | 6/1971 | Adkins et al. | 175/61 |
| 3,637,032 | 1/1972 | Jeter | 175/73 |
| 3,712,391 | 1/1973 | Coyne | 175/61 X |
| 3,743,034 | 7/1973 | Bradley | 175/73 X |
| 3,767,836 | 10/1973 | Geis et al. | 175/61 X |
| 3,817,336 | 6/1974 | Sears | 175/45 X |

*Primary Examiner*—Ernest R. Purser
*Attorney, Agent, or Firm*—Palmer Fultz

[57] ABSTRACT

A portable earth boring machine for the horizontal boring of shafts and the insertion of pipeline casing sections in installations where excavation from the surface is undesirable. The machine is characterized by a steering head positioned at the front of the casings and remotely controlled by the machine operator so as to directionally control the direction of extension of the pipeline as the drilling operation progresses.

14 Claims, 7 Drawing Figures

PORTABLE EARTH BORING MACHINE WITH STEERING HEAD

BACKGROUND OF THE INVENTION

This invention relates to portable earth boring machines and more particularly to a machine adapted for horizontal boring of shafts for the insertion of pipelines at installations where excavation from the surface is undesirable.

SUMMARY OF THE INVENTION

In general, the machine of the present invention comprises a base means that includes spaced track members which are disposed in a trench adjacent to the hill to be bored. The machine further includes a frame means mounted for movement along the track means and such carriage supports a power train for rotating connected sections of auger shafts which comprise a progressively extendable boring auger. The frame means further supports a pusher ring for driving sections of casings into the bored hole and an associated pushing cylinder means is provided for advancing and retracting the frame means and pusher ring along the track means.

In accordance with the present invention the earth boring machine is provided with a novel adjustable steering head which in general comprises a pivotally mounted forward casing section and remote control apparatus for varying the angle of inclination of such steering head so as to directionally control the path of the pipeline as the boring operation progresses.

As another aspect of the present invention the adjustable steering head is easily fabricated by modifying a standard casing section so as to include a simple flush type pivot hinge.

As still another aspect of the present invention the boring machine is provided with a remote grade indicator which includes a casing position sensing means mounted on the above mentioned steering head as well as a read-out gauge positioned at the operator's location with such remote grade indicator serving to continuously read-out the position of the earth boring head above or below the desired pipeline path.

It is therefore an object of the present invention to provide novel steering head means for controlling the establishment of grade in the boring of a pipeline hole.

It is another object of the present invention to provide in an apparatus of the type described a remote grade indicator which provides indicia to the operator with respect to the grade position of the boring head during the drilling operation.

Further objects and advantages of the present invention will be apparent from the following description, reference being had to the accompanying drawings wherein preferred forms of embodiments of the invention are clearly shown.

DESCRIPTION OF THE PREFERRED EMBODIMENTS

Figure 2:
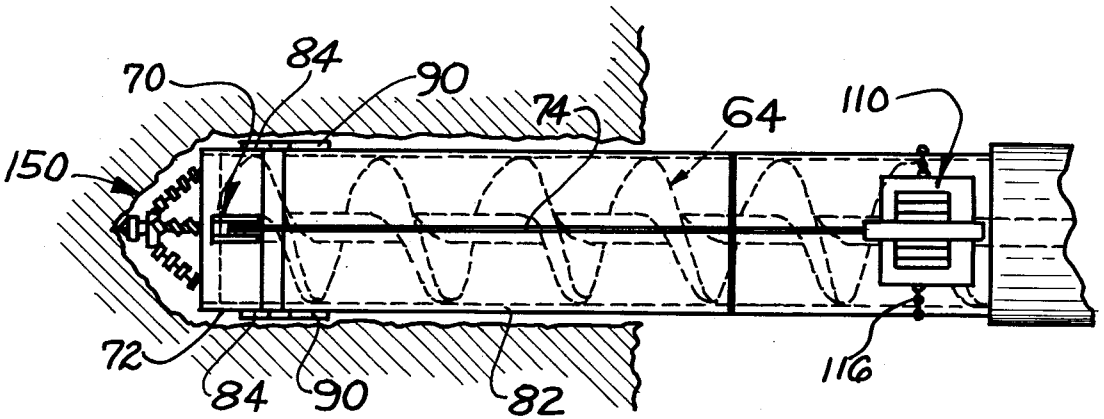
FIG. 2 is a partial top elevational view of the apparatus of FIG. 1.
Figure 1:
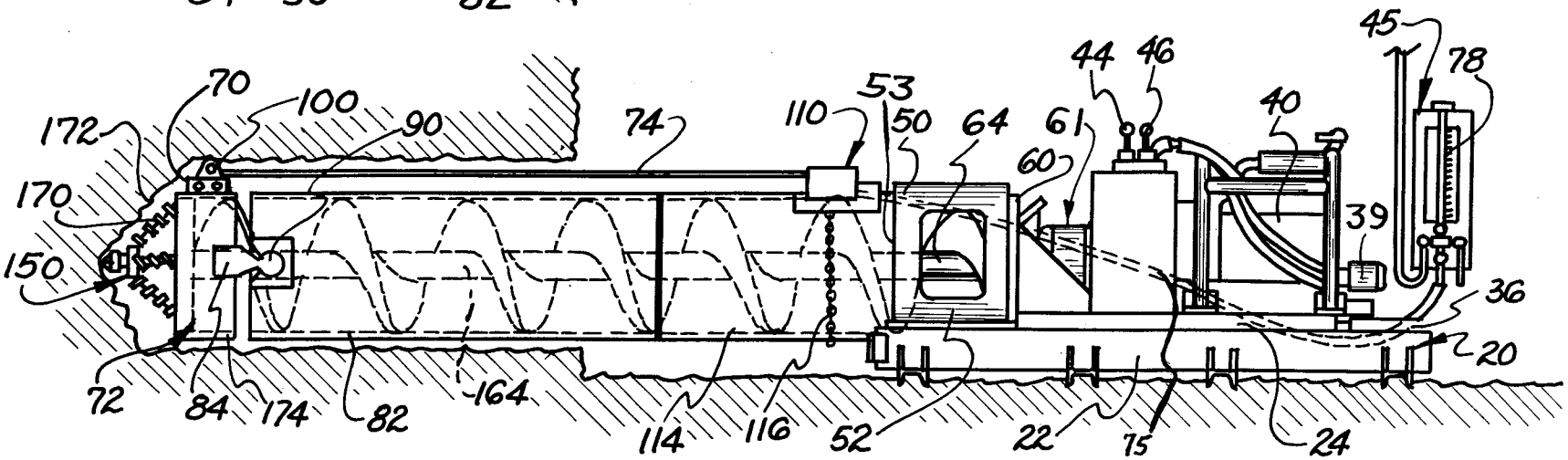
FIG. 1 is a side elevational view of a boring machine constructed in accordance with the present invention.

Referring in detail to the drawings, FIG. 1 illustrates the complete horizontal earth boring machine of the present invention which comprises a base means indicated generally at 20. Such base means includes spaced longitudinally extending track means 22 which support a carriage means indicated generally at 24.

The carriage means 24 is advanced and retracted along track 22 by a hydraulic pushing cylinder, not illustrated with such power cylinder being operatively connected between a power cylinder base 36 and the carriage means 24.

Details of typical power pushing cylinders and pushing cylinder base 36 are disclosed and described in detail in the application of Albert R. Richmond, Ser. No. 867,816 filed Oct. 20, 1969, now U.S. Pat. No. 3,612,195 issued Nov. 12, 1971.

It will be further seen that pressurized fluid for actuating the pushing cylinder is provided by a fluid power system including a pump 39 driven by an engine 40. The fluid power circuit further includes control valve mechanisms 44 and 46 which are actuated when the power cylinders are extended or retracted so as to move carriage 24 forwardly or rearwardly along the track means 22.

Referring again to FIG. 1, the boring machine further includes a pusher ring 50 including a front annular surface 53 for engaging the sections of pipe casing for pushing such sections into the bored hole. Such pusher ring 50 includes a thrust plate means 60 mounted on the carriage means for absorbing the pushing thrust and the boring thrust of the auger assembly indicated generally at 74. A hydraulic drive assembly 61 is interposed between engine 40 and auger assembly 74, such hydraulic drive arrangement being described in copending application Ser. No. 337,211 filed Mar. 1, 1973 now U.S. Pat. No. 3,870,110 issued Mar. 11, 1975.

A typical auger construction for connection with the machine of the present invention is disclosed and described in detail in the application of Albert R. Richmond, Ser. No. 85,614 filed Oct. 30, 1970 now U.S. Pat. No. 3,693,734 issued Sept. 26, 1972.

Reference is next made to the remote grade indicating apparatus of the present invention which is shown in assembled relationship with the boring machine in FIG. 1 and which comprises a sensing means indicated generally at 70 which is mounted on the foremost casing portion 82. The apparatus further includes a gauge means indicated generally at 45, which gauge means is located at the operator's station of the boring machine, as seen in FIG. 1, and serves to continuously provide read-out information with respect to deviation in the inclination or declination of the bored hole as the drilling operation progresses.

Details of the remote grade indicating apparatus are described and disclosed in detail in the co-pending application of Thomas W. Barnes, Ser. No. 354,998 filed Apr. 27, 1973 now U.S. Pat. No. 3,851,716.

In the present application of the remote grade indicating apparatus the fluid conduit connection between the sensing means 70 and gauge 45 is provided by a hollow passage through rod 74 and flexible lines 75 and 77. Such rod 74 serves the additional function of a push rod for actuating the steering head 72 of the present invention in a manner later to be described.

In general, the remote grade indicating apparatus 45–70 functions in accordance with the principle that liquid in a conduit system will seek a common level and since water is present in the sensing means and also in the visual gauge tube 78 of gauge 45 the level of the liquid in the gauge tube will always be the same as the level of the liquid in the sensing means 70. Hence it will be understood that by reading the level in the liquid tube 78, provided with grade indicia above and below a zero datum, the operator can at any time determine the height of the boring auger and steering head with respect to a predetermined datum line.

Reference is next made to the steering head apparatus. One of the modifications which is hydraulically actuated is illustrated in FIGS. 1–3 and 5–7 and includes a pivotted head indicated generally at 72 formed from a length of standard casing section 80 which is pivotally connected to a second casing section 82 at a pivot joint comprising right and left male pivot members 84. Each pivot member includes a male protrusion 86 positioned in recesses 88 formed in female pivot portions 90. It should be pointed out that the male and female pivot portions 84 and 90 are each respectively mounted in cut-outs 92 and 94 which cut-outs can easily be made at the boring site by means of a cutting torch with the pivot portions 84 and 90 being welded in the cut-outs at the welded junctions 96.

With this arrangement the pivot portions 84 and 90 are relatively flush with the outer surface of the casing sections with back-up plates 103 being lapped against the inner surfaces of the second casings section 82 so as to retain the male members 86 in position.

Steering head 72 is actuated by a push rod 74 having its forward end pivotally connected to a bracket 100 at a pivot 102. Push rod 74 is made up of threaded sections so that its length can be continuously increased as the boring of the hole progresses and additional casing sections are inserted into the hole.

Figures 3, 4:
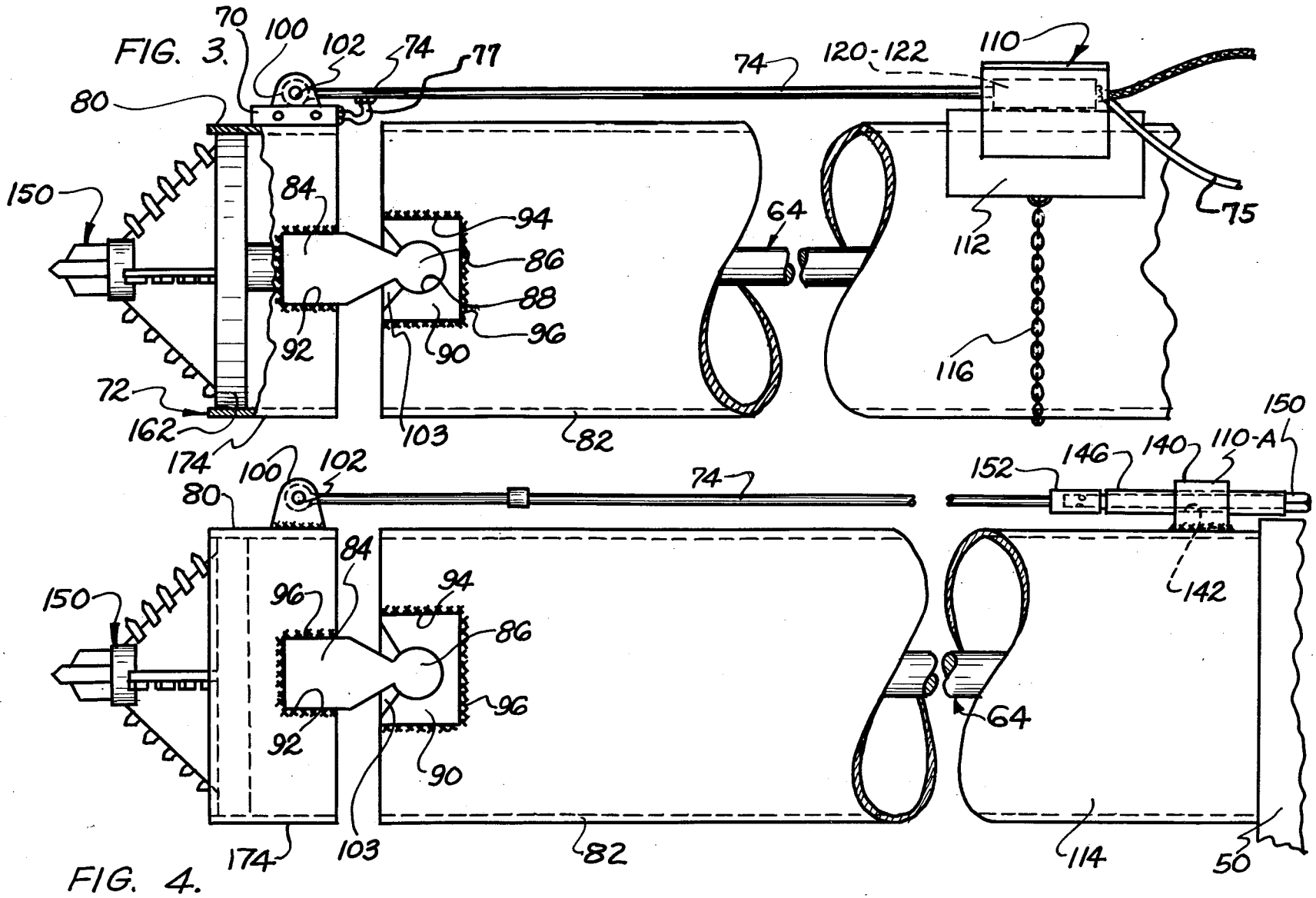
FIG. 3 is a partial side elevational view, partially in section, of the apparatus of FIGS. 1 and 2.
FIG. 4 is a partial side elevational view showing a modified steering head and control apparatus for the machine of FIG. 1.
Figure 6:
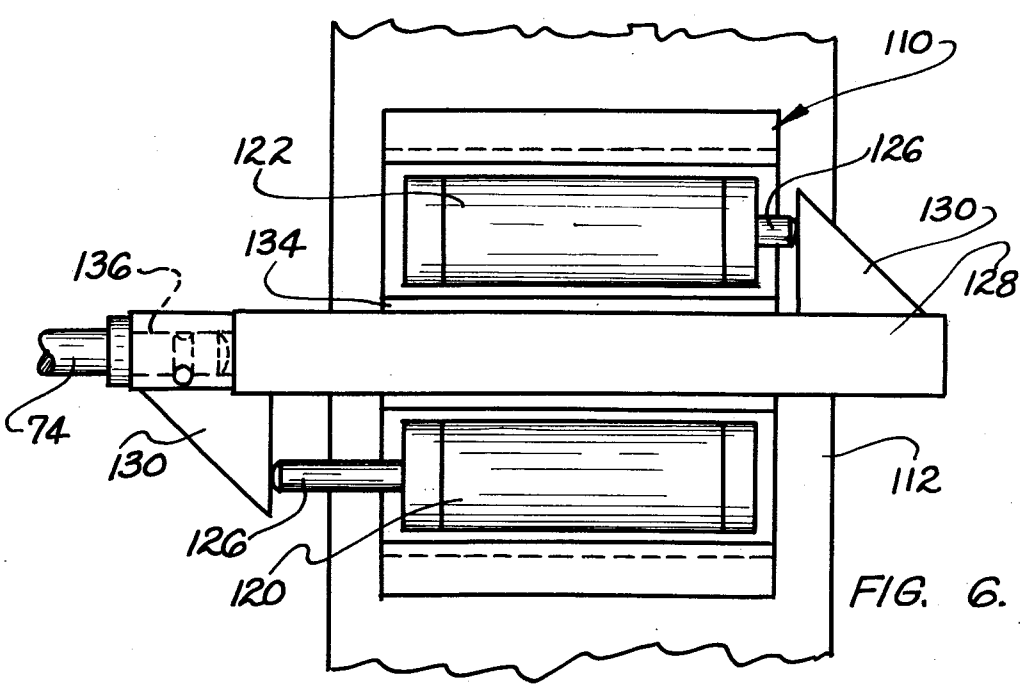
FIG. 6 is a partial top elevational view corresponding to FIG. 5.
Figure 7:
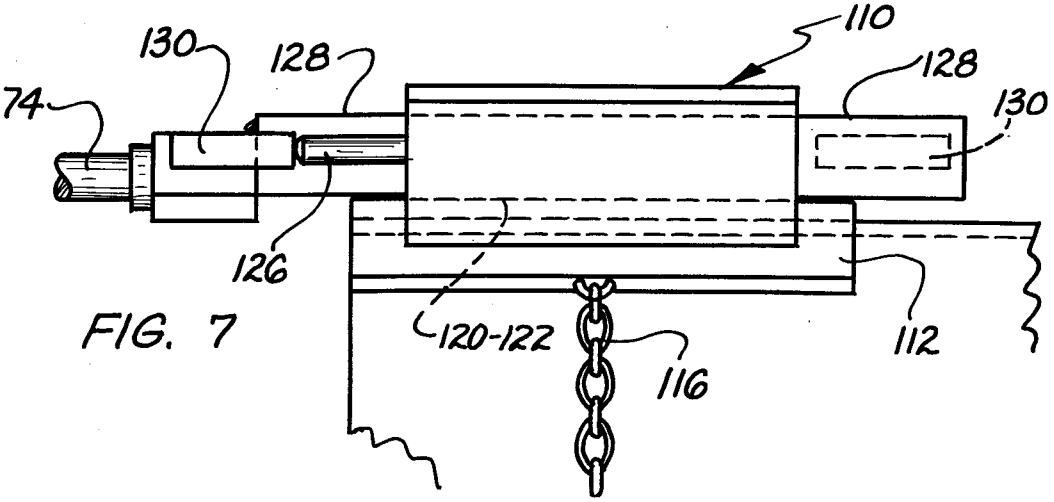
FIG. 7 is an enlarged partial side view of the modification of FIG. 4.
Figure 5:
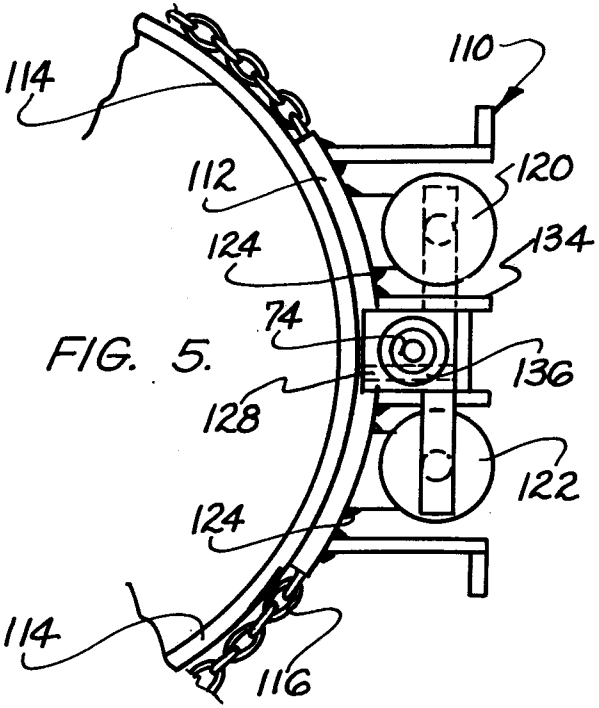
FIG. 5 is a partial front elevational view of the modification of FIG. 4.

Rod 74 is extended and retracted, in one embodiment, by an actuating means indicated generally at 110 in FIGS. 3, 5, and 6. Such assembly includes a saddle 112 which is removably attached to the base casing section 114 by a chain 116 which can be provided with a quick disconnect clamp not illustrated.

Saddle 112 mounts two single acting power cylinders 120 and 122 which are secured to saddle 112 at the welds 124. The power cylinders 120 and 122 include extendable and retractable rods 126 which actuate a slide 128 provided with laterally extending shoulders 130 engaged by the ends of cylinder rods 126. Power cylinders 120 and 122 are of the single acting type and receive pressurized fluid from a conventional pump and valve circuit not illustrated.

Slide 128 is mounted in guides 134 and the ends of actuating rod 74 are connected to the slide at the threaded junction 136.

Reference is next made to FIG. 4 which illustrates a modified control apparatus that includes the same pivot members 84–90 as well as the push rod 74 and bracket 100 previously described.

The modification of FIG. 4 however differs in that it includes a screw type actuating means 110-A that consists of a female threaded member 140 provided with a threaded bore 142. A male threaded member 146 is mounted for extension and retraction upon rotation of a head 150 with the forward end of male member 146 being connected to actuating rod 74 at a swivel connector 152.

Referring again to FIGS. 1–3, a boring head indicated generally at 150 is normally partially extended outwardly of the steering head 72 such that the base plate 162 turns just inside the forward end of steering head 72, and whereas the exposed cutters engage the earth.

A plurality of individual auger sections 164 are in driving connection with the rear end of boring head 150 and are in turn joined end to end at disconnectable junctions in the conventional manner such that auger sections can be added as the boring progresses.

In operation, when it is desired to increase the inclination of steering head 72 the operator pressurizes the previously mentioned hydraulic system so as to extend ram 126 of power cylinder 122. When this occurs the other ram 126 of power cylinder 120 will retract shifting slide 128 rearwardly thereby causing tension on push rod 74 which tilts steering head 72 upwardly about the pivotal center of the pivot portions 86–90. The auger head 150 is driven by engine 40 causing the upper portion 170 of auger head 150 to bite upwardly into the earth fill 172. The drilling action will cause the drillings to drop downwardly and cause wedging action on the under surface 174 of steering head 72. Hence, when the casing sections are advanced by the pressurization of pushing cylinders 36, the upwardly tilted steering head 72 is moved forwardly and over the previously mentioned earth drillings which drillings exert an upward force causing the boring head 150 to drill in an upward direction.

When it is desired to decrease the grade angle, then the previously mentioned power cylinders 120–122 are actuated in the opposite direction causing the steering head 72 to decline whereby the boring auger 150 will work downwardly.

While the forms of embodiments of the present invention as herein disclosed constitute preferred forms, it is to be understood that other forms might be adopted.

What is claimed is:

1. In an earth boring apparatus of the type that forms horizontal holes and pushes sections of casing into said holes, the combination of casing means including a lead casing section including a first longitudinal axis; a second casing section rearwardly adjacent to said lead casing section and including a longitudinal axis normally aligned with said first longitudinal axis; auger means mounted co-axially within said casing sections for removing earth in the path of movement of the casing sections; pivot means connecting said lead casing section to said second casing section; actuating means connected to said lead casing section for varying the angle of said first longitudinal axis of said lead casing section relative to said second longitudinal axis of said second casing section, said angle variation of said lead casing section being affected independently wiith respect to said auger means, said actuating means comprising an actuating rod extending along the walls of said casing sections and including an inner end connected to said lead casing section and an outer end; and a motor connected to said outer end of said actuating rod for extending and retracting said rod.

2. In an earth boring apparatus of the type that forms horizontal holes and pushed sections of casing into said holes, the combination of casing means including a lead casing section including a first longitudinal axis; a second casing section rearwardly adjacent to said lead casing section and including a longitudinal axis normally aligned with said first longitudinal axis; auger means mounted co-axially within said casing sections for removing earth in the path of movement of the casing sections; pivot means comprising a male protrusion welded to one of said casing sections and a female recess, said male protrusion being pivotally disposed in said female recess; actuating means connected to said lead casing section for varying the angle of said first longitudinal axis of said lead casing section relative to said second longitudinal axis of said second casing section, said angle variation of said lead casing section being affected independently with respect to said auger means, said actuating means comprising an actuating rod extending along the walls of said casing sections and including an inner end connected to said lead casing section and an outer end; and a motor connected to said outer end of said actuating rod for extending and retracting said rod.

3. In an earth boring apparatus of the type that forms horizontal holes and pushes sections of casing into said holes, the combination of casing means including a lead casing section including a first longitudinal axis; a second casing section rearwardly adjacent to said lead casing section and including a longitudinal axis normally aligned with said first longitudinal axis; pivot means including a male member including a base portion welded to the outer surface of one of said casing sections and a protruding male portion and a female member formed by a plate welded to the outer surface of said second casing section, said plate including a female recess pivotally receiving said male portion; and actuating means connected to said lead casing section for varying the angle of said first longitudinal axis of said lead casing section relative to said second longitudinal axis of said second casing section.

4. In an earth boring apparatus of the type that forms horizontal holes and pushes sections of casing into said holes, the combination of casing means including a lead casing section including a first longitudinal axis; a second casing section rearwardly adjacent to said lead casing section and including a longitudinal axis normally aligned with said first longitudinal axis; pivot means connecting said lead casing section to said second casing section; actuating means including an actuator base mounted on said apparatus, a pivot bracket mounted on said lead casing section, power means mounted on said actuator base, and an actuating rod operatively connecting said power means with said pivot bracket, said actuating means serving to vary the angle of said first longitudinal axis of said lead casing section relative to said second longitudinal axis of said second casing section.

5. In an earth boring apparatus of the type that forms horizontal holes and pushes sections of casing into said holes, the combination of casing means including a lead casing section including a first longitudinal axis; a second casing section rearwardly adjacent to said lead casing section and including a longitudinal axis normally aligned with said first longitudinal axis; pivot means connecting said lead casing section to said second casing section; and actuating means connected to said lead casing section for varying the angle of said first longitudinal axis of said lead casing section relative to said second longitudinal axis of said second casing section, said actuating means comprising an actuator base mounted on said apparatus, a pivot bracket mounted on said lead casing section, power means mounted on said actuator base, and an actuating rod operatively connecting said power means with said pivot bracket.

6. The apparatus defined in claim 3 wherein said actuating means comprises an actuator base mounted on said apparatus; a pivot bracket mounted on said lead casing section; power means mounted on said actuator base; and an actuating rod operatively connecting said power means with said pivot bracket.

7. In an earth boring apparatus of the type that forms horizontal holes and pushes sections of casing into said holes, the combination of casing means including a lead casing section including a first longitudinal axis; a second casing section rearwardly adjacent to said lead casing section and including a longitudinal axis normally aligned with said first longitudinal axis; pivot means connecting said lead casing section to said second casing section; actuating means including a pivot bracket mounted on said lead casing section; and an actuating rod including a front end pivotally connected to said pivot bracket and a rear end extended outwardly of the bored hole for remote actuation of said lead casing section to vary the angle of said first longitudinal axis of said lead casing section relative to said second longitudinal axis of said second casing section.

8. In an earth boring apparatus of the type that forms horizontal holes and pushes sections of casing into said holes, the combination of casing means including a lead casing section including a first longitudinal axis; a second casing section rearwardly adjacent to said lead casing section and including a longitudinal axis normally aligned with said first longitudinal axis; pivot means comprising a male protrusion welded to one of said casing sections and a female recess; said male protrusion being pivotally disposed in said female recess; actuating means including a pivot bracket mounted on said lead casing section; and an actuating rod including a front end pivotally connected to said pivot bracket and a rear end extended outwardly of the bored hole for remote actuation of said lead casing section to vary the angle of said first longitudinal axis of said lead casing section relative to said second longitudinal axis of said second casing section 9. In an earth boring apparatus of the type that forms horizontal holes and pushes sections of casing into said holes, the combination of casing means including a lead casing section including a first longitudinal axis; a second casing section rearwardly adjacent to said lead casing section and including a longitudinal axis normally aligned with said first longitudinal axis; pivot means including a male member including a base portion welded to the outer surface of one of said casing sections and a protruding male portion and a female member formed by a plate welded to the outer surface of said second casing section, said plate including a female recess pivotally receiving said male portion; actuating means including a pivot bracket mounted on said lead casing section; and an actuating rod including a front end pivotally connected to said pivot bracket and a rear end extended outwardly of the bored hole for remote actuation of said lead casing section to vary the angle of said first longitudinal axis of said lead casing section relative to said second longitudinal axis of said second casing section

10. The earth boring apparatus means of claim 7 wherein said casing includes grade variation sensing means for progressive extension into the earth fill; and gauge means for location adjacent the earth fill and connected to the sensing means, said gauge means including read-out indicia for informing the operator of grade deviations of the casing means.

11. The earth boring apparatus means of claim 4 wherein said casing includes grade variation sensing means including a liquid chamber for progressive extension into the earth fill; and gauge means including a liquid chamber for location adjacent the earth fill and connected to the sensing means, said gauge means including read-out indicia for informing the operator of grade deviations of the casing means, said actuating rod forming a conduit connecting said liquid chambers, and a liquid within said chambers and conduit.

12. A mechanism for controlling the direction of movement of a pipe being driven underground generally along a horizontal path, and wherein a mechanical device is employed at the rear end of the pipe to forcibly drive the pipe along the path, said mechanism comprising: a pipe; an auger means mounted coaxially within the pipe for removing earth in the path of the movement of the pipe; a cylindrical head pivotally mounted to the forward end of the pipe, said cylindrical head being pivotable independently of said auger means; and control means for inclining said cylindrical head with respect to the longitudinal axis of said pipe, the movement of said cylindrical head being inclined independently with respect to said auger means.

13. The control mechanism defined in claim 12 further comprising a mechanical device employed at the rear end of said pipe to forcibly drive said pipe along said path and wherein said cylindrical head has side flanges pivotally carried at the forward end of said pipe which permit said cylindrically shaped head to be pivoted a limited distance with respect to the longitudinal axis of said pipe and said control means being carried by said cylindrically shaped head and extending rearwardly for access at said mechanical device end of said pipe, said control means being axially movable with respect to said pipe to move said cylindrical head with respect to the longitudinal axis of said pipe.

14. The control mechanism defined in claim 12 wherein said auger means extend beyond or forwardly of said cylindrical head for boring into said ground and removing said ground through said pipe; and a mechanical device employed at the rear end of said pipe to forcibly drive said pipe along said path, said mechanical device exerting a force upon said pipe to move said pipe forwardly into said ground, the direction of movement of said pipe being controlled by the position of said cylindrical head with respect to the longitudinal axis of said pipe.

* * * * *